United States Patent [19]

Schuler et al.

[11] Patent Number: 4,511,196

[45] Date of Patent: Apr. 16, 1985

[54] PRINTED CIRCUIT BOARD CONNECTOR WITH INTEGRAL GROUND PLANE

[75] Inventors: John G. Schuler, La Mesa; Lowell R. Lingenfelter, La Jolla, both of Calif.

[73] Assignee: Teledyne Industries, Inc., Los Angeles, Calif.

[21] Appl. No.: 572,356

[22] Filed: Jan. 20, 1984

[51] Int. Cl.[3] ..... H01R 13/048

[52] U.S. Cl. ..... 339/14 R; 29/842; 339/17 LM

[58] Field of Search ..... 29/842; 339/14 R, 17 L, 339/17 LC, 17 LM, 17 GM, 18 L, 183

[56] References Cited

U.S. PATENT DOCUMENTS 3,334,325 8/1967 Conrad et al. ..... 339/14 R 3,591,834 7/1971 Kolias ..... 339/17 LM X 4,057,311 11/1977 Evans ..... 339/17 M 4,223,968 9/1980 Kawabata et al. ..... 339/14 R

*Primary Examiner*—Eugene F. Desmond

*Attorney, Agent, or Firm*—Reagin & King

[57] ABSTRACT

A connector with an integral ground plane for making connections between two circuit boards is disclosed in which the connector has a bar-shaped body including generally C-shaped contacts extending in a row on opposite sides of the body. A ground plane in the form of a thin conductive sheet is positioned in the body between the rows, and has a predetermined pattern of projections which are bent to contact specific ones of the C-shaped contacts when the connector is assembled between the two circuit boards.

4 Claims, 7 Drawing Figures

PRINTED CIRCUIT BOARD CONNECTOR WITH INTEGRAL GROUND PLANE

BACKGROUND OF THE INVENTION

This invention relates to printed circuit board connectors and, more particularly, to a printed circuit board connector having an integral ground plane.

A large number of multi-terminal high density connectors have been developed over the years for use in interconnecting multiple printed circuit boards. Many of these connectors have proven successful in interconnecting circuits carrying high level, low frequency signals. However, such connectors have generally been found to provide unacceptable performance in instances where the signals to be carried are either very low in amplitude or high in frequency.

One shortcoming of the prior art connectors of the type described above is the inability to provide a ground plane suitable for shielding between circuits. Such shielding is necessary to minimize both noise and cross coupling in circuits employing low amplitude or high frequency signals.

Accordingly, it is an object of the present invention to provide a new and improved printed circuit board connector.

It is another objective of the present invention to provide a new printed circuit board connector suitable for use with low amplitude and high frequency signals.

It is yet another objective of the present invention to provide a multi-terminal printed circuit board connector having an integral ground plane.

SUMMARY OF THE INVENTION

The foregoing and other objects of the invention are accomplished by a connector having a generally bar-shaped body formed of an insulating material. A thin sheet of conductive material is used to form the ground plane and has a central portion extending along the length of and affixed within the body. The thin sheet includes first and second pluralities of spaced-apart finger-like resilient projections which extend through the body from opposite sides of the central portion. The first and second pluralities of projections are bent across first and second opposing sides, respectively, of the body, where the length of, and the direction of bend of each of the projections is made in accordance with a predetermined ground plane pattern.

A plurality of resilient electrically conductive contacts are spaced apart in two rows along the length of the body, the rows being parallel to and on opposing sides of the central portion of the conductive sheet. Each contact has a central portion affixed within the body and first and second free ends extending from the first and second sides, respectively of the body. Each free end is bent across the respective side of the body in a direction toward the sheet of conductive material so that when a particular free end is pressed toward its respective side, a portion of that free end is forced into contact with an adjacent one of the finger-like projections if that adjacent projection is bent toward the particular free end.

A novel method of making the connector of the present invention includes the steps of molding a row of contacts into each of separate halves of the bar-shaped body. The ground plane is formed of the above described conductive sheet having the finger-like projections formed in accordance with the predetermined ground plane pattern. The connector is assembled by sandwiching the central portion of the conductive sheet between the two halves of the body and then bending the free ends of the contacts toward each other over the ground plane projection.

Other features, objects, and advantages of the invention will become apparent from a reading of the specification when taken in conjunction with the drawings in which like reference numerals refer to like elements in the several views.

DESCRIPTION OF THE PREFERRED EMBODIMENT

Figures 1, 2, 3, 4:
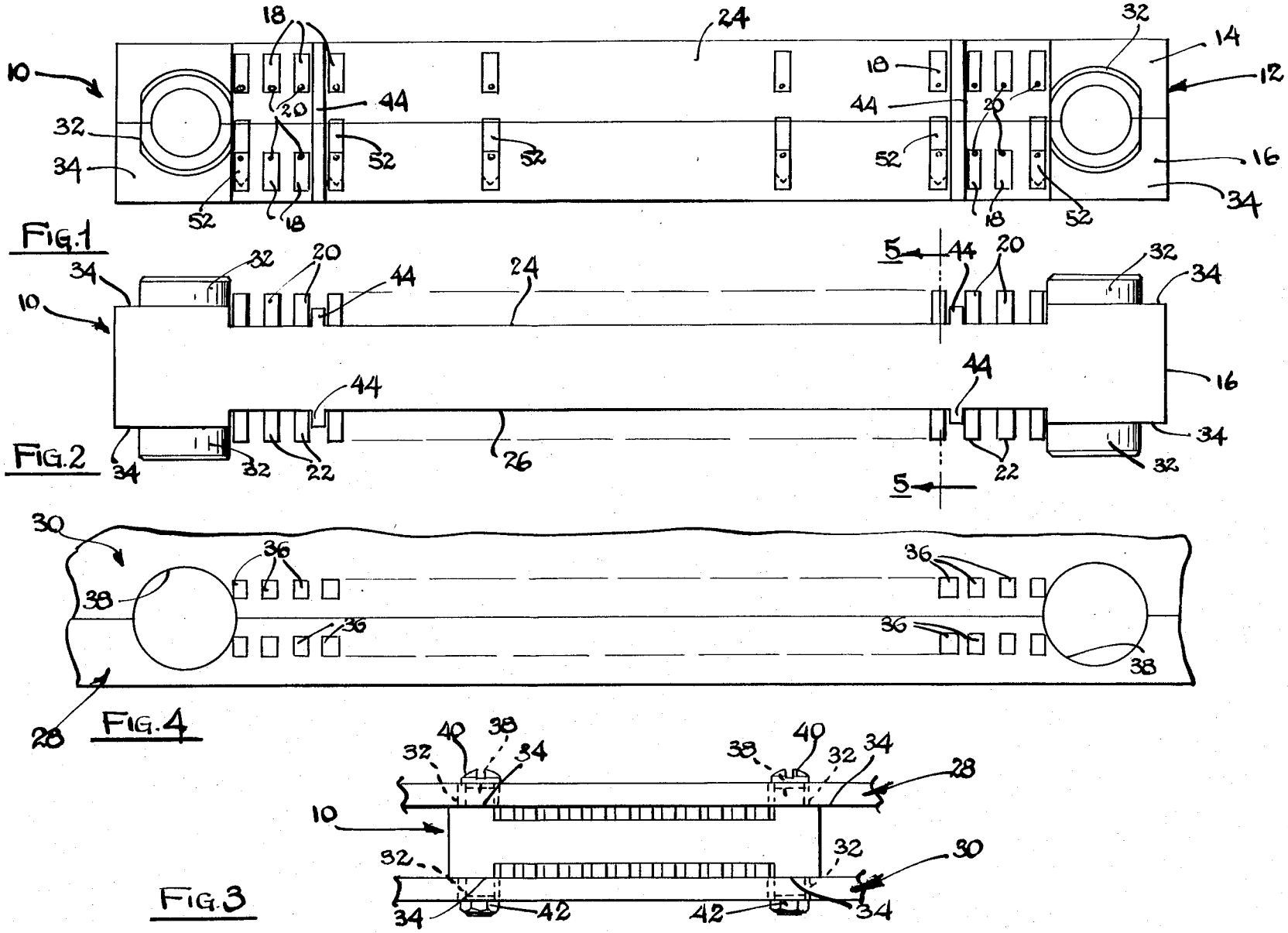
FIG. 1 is a top view of a connector constructed in accordance with the present invention.
FIG. 2 is a side view of the connector of FIG. 1.
FIG. 3 is a side view showing the connector of FIG. 1 fastened between two printed circuit boards in a typical application of providing interconnections between these boards.
FIG. 4 is a top view of a portion of one of the circuit boards of FIG. 3 showing the position of printed circuit pads used to make connections with the connector of FIG. 1.

FIGS. 1 and 2 are top and side views, respectively, of the connector 10 of the present invention. The connector 10 includes a generally bar-shaped body 12 composed of two halves 14 and 16, each formed of a moldable insulating material such as Valox plastic, manufacutred by General Electric Company.

Embedded in each of the halves 14 and 16 is a row of spaced-apart, resilient, electrically conductive contact elements 18 formed of a material such as copper alloy. As shown in the cross-sectional view of FIG. 5, the central portion of each of the elements 18 is molded within the respective body half 14 and 16. First and second free ends 20 and 22 of each of the elements 18 project from opposing surfaces 24 and 26, respectively, of the body 12, and are bent at an angle across these surfaces and toward each other.

The connector 10 described thus far may be used as shown in FIG. 3 to interconnect two printed circuit boards 28 and 30 in the following manner. Each of the boards 28 and 30 includes a pattern consisting of two rows of contact pads 36 located between openings 38, as shown in FIG. 4. Generally circular hollow bosses 32 extend from shoulders 34 on opposite ends of the connector 10, as shown in FIG. 2. The bosses 32 are designed to fit into respective openings 38 in the boards 28 and 30. Bolts 40 extend through openings 38 and bosses 32 and are fastened with nuts 42, whereby the boards 28 and 30 are held against the shoulders 34 of the connector 10. In this position, the pads 36 on the surface of the boards 28 and 30 depress the resilient contact ends 20 and 22, respectively, thus establishing electrical connections between these boards through contacts 18. Raised barriers 44 positioned between selected contacts 18 project above the surfaces 24 and 26 at the same height as the shoulders 34. These barriers 44 help to maintain the surface of the boards 28 and 30 parallel to the surfaces 24 and 26 of the connector 10 and also serve to align the free ends 20 and 22 of the contacts 18.

Figure 5:
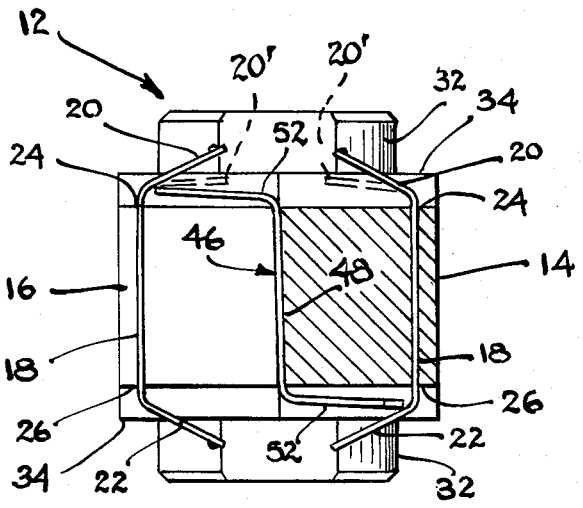
FIG. 5 is a cross-sectional side view of the connector of FIG. 1 taken along the line 5—5 of FIG. 2.
Figure 6:
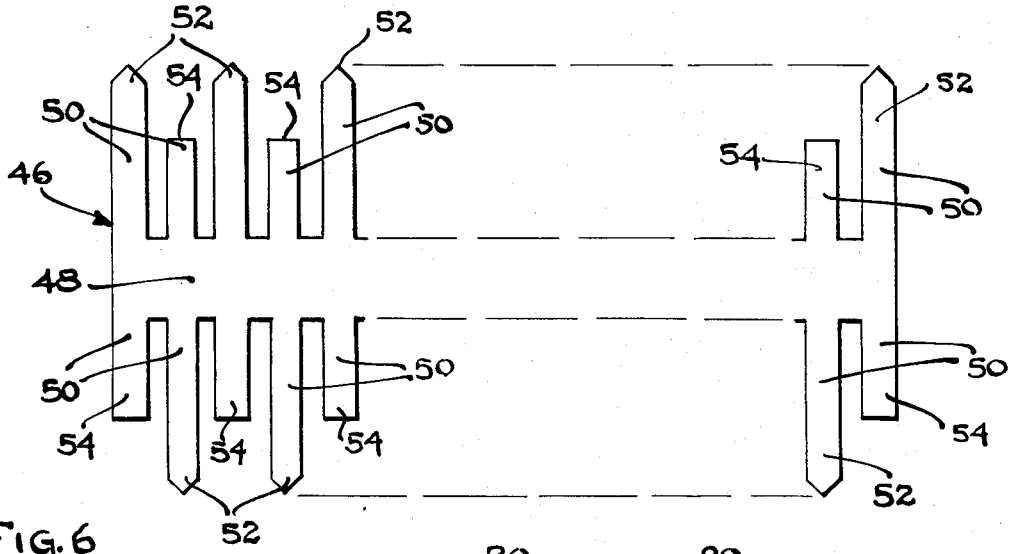
FIG. 6 is a front view of a conductive sheet for use as a typical ground plane in the connector of FIG. 1.

The connector 10 is provided with an integral ground plane in the following manner. Referring to FIG. 6, a thin sheet 46 of a resilient conductive material, such as a copper alloy, is formed having a central portion 48 from which extends a pattern of finger-like projections 50. The projections 50 are spaced apart along the length of the sheet 46 corresponding to the spacing of the contacts 18 in the connector 10. The long projections, designated 52 in FIG. 6, are designed to contact particular ones of the free ends 20 and 22 of the contacts 18 to connect these ends to the common ground plane 46. For those projections 50 corresponding to contacts 18 where no grounding is required, the projections 50 are cut short at line 54. The long projections 52 are bent approximately perpendicular to the portion 48 along a line colinear with the line 54, where the direction of bend of each projection 52 depends on the particular free end to be grounded, as described below Referring to the cross-sectional view of the connector 10 shown in FIG. 5, the central portion 48 of the cut and bent sheet 46 is sandwiched between the connector halves 14 and 16. The entire assembly is then fastened together using either adhesive, ultrasonic welding or other fastening technique well known to those skilled in the art. As shown in FIG. 5, in the completed assembly the previously bent projections 52 extend across the surfaces 24 and 26 and between those surfaces and the bent free ends 20 and 22, respectively, of the contacts 18.

Figure 7:
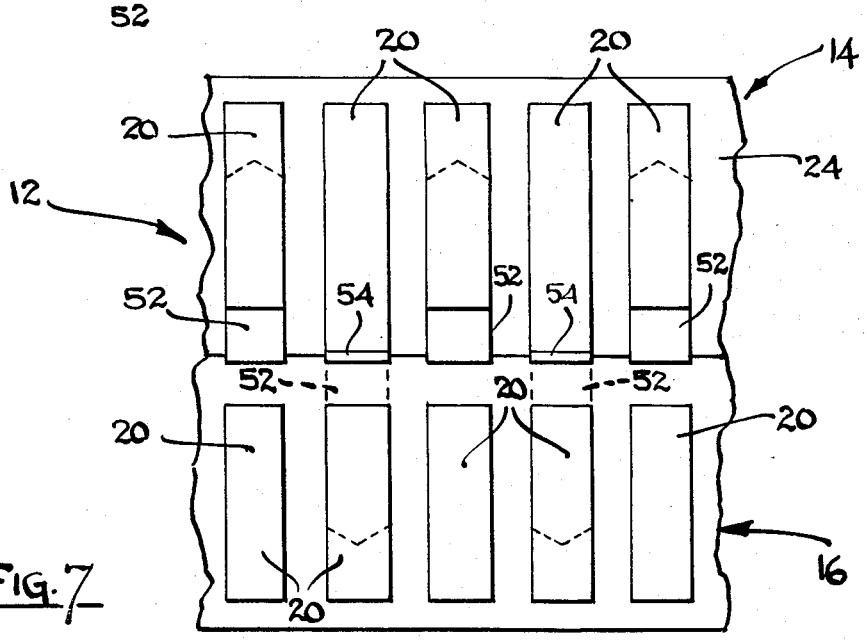
FIG. 7 is a fragmented top view of the connector of FIG. 1 constructed using the ground plane of FIG. 6.

FIG. 7 is a fragmented top view of the assembled connector showing the positions of the projections 52 relative to the free ends 20 of the contacts 18. The three projections 52 shown in the upper left portion of the sheet 46 of FIG. 6 are shown bent underneath alternating free ends 20 in connector half 14, where the ends 54 of the shortened projections 50 are approximately flush to the surfaces 24 and 26. The two projections 52 shown in the lower left portion of the sheet 46 of FIG. 6 (designated with dotted lead lines in FIG. 7) are bent downward underneath alternating free ends 22 adjacent the bottom surface 26 of the connector half 16.

As described above, when the connector 10 is assembled between the two printed circuit boards 28 and 30, the resilient free ends 29 and 22 are pressed toward the surfaces 24 and 26, respectively. Referring to FIG. 5, the free ends designated 20' and shown in dashed lines indicate the depressed positions of the ends 20. The ends 22 are similarly depressed toward the surface 26. It may be seen that when the ends 20 and 22 are depressed, they are forced into contact with adjacent projections 52. The projections 52 are provided with pointed ends to increase the contact pressure between them and the respective free ends 20 and 22.

It will be appreciated that when a free end 20 or 22 is pressed into contact with a projection 52, the corresponding contact 18 is electrically connected in common with the conductive sheet 46. The pattern of the projections 52 of the sheet 46 determines which of the contacts 18 will be grounded. Accordingly, any one of a multitude of contact grounding patterns may be provided in the connector 10 simply by cutting and bending the sheet 46 in the appropriate manner. By way of example, the top view of FIG. 1 shows a ground plane pattern in which every fourth contact 18 in the connector half 16 is grounded by projections 52 contacting appropriate free ends 20. From cross-sectional view of FIG. 5, it may be seen that the placement of the central portion 48 of the sheet 46 between opposite rows of contacts 18 causes the portion 48 to act as a shield between these two rows, further enhancing the high frequency characteristics of the connector 10.

While there has been shown and described a preferred embodiment of the invention, it is to be understood that various other adaptations and modifications may be made within the spirit and scope of the invention. It is thus intended that the invention be limited in scope only by the appended claims.

What is claimed is:

1. A connector having an integral ground plane, comprising:

a generally bar-shaped body formed of an insulating material;

a sheet of conductive material having a central portion extending along the length of and affixed within the body and having a first plurality of spaced-apart finger-like resilient projections extending from and bent across a first side of the body, where the extension and direction of bend of each of the projections is made in accordance with a predetermined pattern; and a plurality of resilient electrically conductive contacts spaced apart along the length of the body, each contact having a central portion affixed within the body along a plane generally parallel to the central portion of the conductive sheet, and having a first free end extending from and bent across the first side of the body so that when a particular first free end is pressed toward the first side, a portion of that first free end is forced into contact with an adjacent one of the finger-like projections if that adjacent projection is bent toward the particular first free end.

2. The connector of claim 1 in which the sheet of conductive material includes a second plurality of spaced-apart finger-like resilient projections extending from and bent across a second side of the body opposite the first side, where the extension and direction of bend of each of the second plurality of projections is made in accordance with the predetermined pattern; and in which each of the plurality of resilient contacts includes a second free end extending from and bent across the second side of the body so that when a particular second free end is pressed toward the second side, a portion of that second free end is forced into contact with an adjacent one of the second plurality of finger-like projections if that adjacent projection is bent toward that particular second free end.

3. A connector having an integral ground plane, comprising:

a generally bar-shaped body formed of an insulating material;

a sheet of conductive material having a central portion extending along the length of and affixed within the body and having first and second pluralities of spaced-apart finger-like resilient projections extending through the body from opposite sides of the central portion and bent across first and second opposing sides, respectively, of the body, where the extension and direction of bend of each of the projections is made in accordance with a predetermined pattern; and a plurality of resilient electrically conductive contacts spaced apart in two rows along the length of the body, the rows being generally parallel to and on opposing sides of the central portion of the conductive sheet, each contact having a central portion affixed within the body and first and second free ends extending from the first and second sides, respectively, of the body, where each free end is bent across the respective side of the body in a direction toward the sheet of conductive material so that when a particualr free end is pressed toward its respective side, a portion of that free end is forced into contact with an adjacent one of the finger-like projections if that adjacent projection is bent toward the particular free end.

4. A method of making a connector having an integral ground plane, comprising:

providing a plurality of resilient electrical contacts each having a central portion and first and second free ends;

providing first and second halves of a generally bar-shaped body, each half formed of an insulating material and where the contacts have their central portion embedded in at least one half of the body to form a row of spaced apart contacts;

providing a sheet of conductive materials;

forming the sheet to have spaced-apart finger-like projections extending from at least one end of a central portion, where the spacing of the projections corresponds to the spacing of the contacts;

reducing the length of particular ones of the projections in accordance with a predetermined ground plane pattern;

bending the projection approximately perpendicular to the central portion of the sheet, where the direction of bend of each projection is made in accordance with the predetermined pattern;

fastening the first and second halves on opposite sides of the central portion of the sheet; and bending the free ends of the contacts toward the central portion of the sheet, whereby when a particular free end is pressed toward the body, a portion of that free end is forced into contact with an adjacent one of the finger-like projections if that adjacent projection is bent toward the particular free end.

* * * * *